US009981298B2

(12) United States Patent
Shinmiya et al.

(10) Patent No.: US 9,981,298 B2
(45) Date of Patent: May 29, 2018

(54) METHOD OF PRODUCING POLYGONAL CLOSED CROSS-SECTION STRUCTURAL COMPONENT WITH A CURVED FORM AND POLYGONAL CLOSED CROSS-SECTION STRUCTURAL COMPONENT PRODUCED BY THE METHOD

(71) Applicant: JFE Steel Corporation, Tokyo (JP)

(72) Inventors: Toyohisa Shinmiya, Tokyo (JP); Yasuhiro Kishigami, Tokyo (JP); Yuji Yamasaki, Tokyo (JP)

(73) Assignee: JFE Steel Corporation (JP)

( * ) Notice: Subject to any disclaimer, the term of this patent is extended or adjusted under 35 U.S.C. 154(b) by 0 days. days.

(21) Appl. No.: 14/913,786

(22) PCT Filed: Aug. 22, 2014

(86) PCT No.: PCT/JP2014/072010
§ 371 (c)(1),
(2) Date: Feb. 23, 2016

(87) PCT Pub. No.: WO2015/029903
PCT Pub. Date: Mar. 5, 2015

(65) Prior Publication Data

US 2016/0243603 A1 Aug. 25, 2016

(30) Foreign Application Priority Data

Aug. 26, 2013 (JP) ..... 2013-174812

(51) Int. Cl.
*B21D 5/02* (2006.01)
*B21D 47/01* (2006.01)
(Continued)

(52) U.S. Cl.
CPC ..... *B21D 5/02* (2013.01); *B21C 23/12* (2013.01); *B21C 35/023* (2013.01);
(Continued)

(58) Field of Classification Search
CPC ..... B21D 39/02; B21D 51/06; B21D 5/02; B21D 5/10
See application file for complete search history.

(56) References Cited

U.S. PATENT DOCUMENTS

2006/0249969 A1 11/2006 Grüneklee et al.
2011/0174409 A1 7/2011 Higai et al.
(Continued)

FOREIGN PATENT DOCUMENTS

CN 102672011 9/2012
DE 35 13 382 A1 10/1986
(Continued)

OTHER PUBLICATIONS

Chinese Office Action dated Jun. 29, 2017, of corresponding Chinese Application No. 2014801146791.X, along with a Search Report in English.
(Continued)

*Primary Examiner* — Debra Sullivan
(74) *Attorney, Agent, or Firm* — DLA Piper LLP

(57) ABSTRACT

A method of producing a polygonal closed cross-section structural component includes press-forming a metal sheet into a gutter-shaped pre-processed part with a curved form along its longitudinal direction having plural ridge lines corresponding to corner portions of the polygonal closed cross-section in a cross-sectional form developed by cutting the component at a position corresponding to the ridge line located at the innermost side in the radial direction to provide a flange portion extending along the ridge line at the resulting respective ends, and press-forming the pre-processed part to deform inwardly in the cross-sectional direction at a position of one or more of the plural ridge lines to butt the ridge lines located at the innermost side and the flange portions to each other.

2 Claims, 3 Drawing Sheets

(51) Int. Cl.

| | |
|---|---|
| ***B21D 11/08*** | (2006.01) |
| ***B21D 22/02*** | (2006.01) |
| ***B21D 5/10*** | (2006.01) |
| ***B21C 23/12*** | (2006.01) |
| ***B21C 35/02*** | (2006.01) |
| ***B21D 47/04*** | (2006.01) |

(52) U.S. Cl.

CPC ..... *B21C 35/026* (2013.01); *B21D 5/10* (2013.01); *B21D 11/08* (2013.01); *B21D 22/02* (2013.01); *B21D 47/01* (2013.01); *B21D 47/04* (2013.01)

(56) References Cited

U.S. PATENT DOCUMENTS

| | | | | |
|---|---|---|---|---|
| 2012/0204993 | A1 | 8/2012 | Higai et al. | |
| 2013/0091919 | A1 | 4/2013 | Flehmig et al. | |
| 2015/0114070 | A1* | 4/2015 | Higai | B21D 5/01 72/356 |
| 2015/0165511 | A1* | 6/2015 | Higai | B21D 39/02 72/379.2 |

FOREIGN PATENT DOCUMENTS

| | | | | | |
|---|---|---|---|---|---|
| JP | 2000-263169 | A | | 9/2000 | |
| JP | 2003-311329 | A | | 11/2003 | |
| JP | 2006116552 | A | * | 5/2006 | B21D 5/01 |
| JP | 2008-119723 | A | | 5/2008 | |
| JP | 2010-064138 | | | 3/2010 | |
| JP | 2010-75945 | | | 4/2010 | |
| JP | 2011-62713 | | | 3/2011 | |
| JP | 2013-526412 | | | 6/2013 | |

OTHER PUBLICATIONS

Chinese Office Action dated Dec. 25, 2017, of corresponding Chinese Application No. 201480046791.X, along with a Search Report in English.

* cited by examiner

METHOD OF PRODUCING POLYGONAL CLOSED CROSS-SECTION STRUCTURAL COMPONENT WITH A CURVED FORM AND POLYGONAL CLOSED CROSS-SECTION STRUCTURAL COMPONENT PRODUCED BY THE METHOD

TECHNICAL FIELD

This disclosure relates to a method of producing a polygonal closed cross-section structural component with a curved form along its longitudinal direction, which is used in automobiles, domestic electric appliances and the like, and a polygonal closed cross-section structural component produced by the method.

BACKGROUND

In the field of automobiles, domestic electric appliances and the like is known a component having a closed cross-section structure formed by shaping two parts separately and joining these parts to each other. Also, hydroforming or roll forming is known as a method of producing a closed cross-section structural component with a curved form along its longitudinal direction.

In the conventional hydroforming method, it is necessary to weld all of peripheral edge portions before the pouring of a machining fluid. JP-A-2008-119723 discloses a hydroforming machine, a hydroforming method and a hydroformed product, in which deep drawn products having an excellent sealing property in bulging can be obtained from two or more metal sheets without lap-welding all peripheral edge portions and the production efficiency capable of simultaneously shaping plural components is excellent.

JP-A-2000-263169 discloses a method of producing a closed cross-section curved long material comprising a roll forming step of shaping a band plate into nearly a closed cross-section with multistage forming rollers, joining butt portions thereof with a caulking roller and curving the resulting closed cross-section long material with many bending rollers along a moving direction of the band plate.

JP-A-2003-311329 discloses a technique capable of obtaining a pressed product with a distortion on the way of a closed cross-section form from a raw material in which a high-quality closed cross-section pressed product having a light weight and a high-rigidity distorted portion is provided at a low cost.

JP-A-2011-062713 discloses a method of producing a closed cross-section structural component having a curved form along its longitudinal direction through press forming by joining two folded steel sheets each having a curved form at their both flange portions to each other and deforming to move the flange portions close to each other.

However, the hydroforming method disclosed in JP '723 and the roll forming method disclosed in JP '169 have problems that the production rate is slow and equipment cost is high compared to the press forming. Also, the press forming method disclosed in JP '329 has a problem that it is difficult to perform butting of the end faces in a component having a curved form in its longitudinal wall portion. Further, the method disclosed in JP '713 has a problem that there is a limitation in the weight reduction because it is required to join flange portions of two press formed steel sheets to each other by welding.

It could therefore be helpful to provide a method of producing a polygonal closed cross-section structural component with a curved form along its longitudinal direction that is capable of reducing the weight of a product at a low cost only by press forming, and a polygonal closed cross-section structural component produced by the method.

SUMMARY

We examined a method of producing a polygonal closed cross-section structural component with a curved form along its longitudinal direction from a metal sheet to reduce a weight of the product by minimizing a flange portion and found that when a pre-processed part with a curved form along its longitudinal direction has a radius of curvature equal to a radius of curvature of the curved form along the longitudinal direction of the polygonal closed cross-section component at each ridge line corresponding to each corner portion of the component, if it is intended to reduce the form of the pre-processed part into the form of the component in a cross-sectional direction by press forming, a length of a ridge line in the component becomes shorter than a length of a ridge line located in the pre-processed part inward in the radial direction of the curved form and, hence, a surplus portion is produced in the sheet material and causes wrinkles in the component so that when the radius of curvature in the curved form along the longitudinal direction of the pre-processed part to cause a length difference in the each ridge line between the component and the pre-processed part or to make the each length of the ridge line in the component longer, the polygonal closed cross-section structural component with the curved form along its longitudinal direction can be produced by press forming without causing wrinkles.

We thus provide a method of producing a polygonal closed cross-section structural component with a curved form along its longitudinal direction having plural ridge lines corresponding to corner portions of the polygonal closed cross-section and two flange portions extending in parallel to a flat face including a ridge line located at an innermost side in a radial direction of the curved form of the component along the longitudinal direction among the above ridge lines from a metal plate, characterized in that the metal sheet is first press-formed into a gutter-shaped pre-processed part with a curved form along its longitudinal direction having plural ridge lines corresponding to the corner portions of the polygonal closed cross-section of the component in a cross-sectional form developed by cutting the component at a position corresponding to the ridge line located at the innermost side in the radial direction to provide a flange portion extending along the ridge line at the resulting respective ends wherein each of the ridge lines corresponding to the corner portions has a radius of curvature equal to or smaller than a radius of curvature of the corresponding ridge line of the component to have a length equal to or shorter than the length of the corresponding ridge line; and the pre-processed part is then press-formed to deform inwardly in the cross-sectional direction at a position of one or more of the plural ridge lines to butt the ridge lines located at the innermost side and the flange portions to each other.

In the method of producing a polygonal closed cross-section structural component with a curved form, a polygonal line of a groove-shaped cross-section may be press-formed along one or more of the plural ridge lines of the pre-processed part at such a ridge line to easily deform the pre-processed part inward in the cross-sectional direction at a position of such a ridge line whereby the pre-processed part is surely deformed inward in the cross-sectional direction at the position of the ridge line so that the component can be press-formed from the pre-processed part in a high accuracy.

A polygonal closed cross-section structural component with a curved form is characterized by producing through the aforementioned method of producing a polygonal closed cross-section structural component with a curved form.

In the method producing a polygonal closed cross-section structural component with a curved form, when a metal sheet is shaped into a polygonal closed cross-section structural component with a curved form along its longitudinal direction having plural ridge lines corresponding to corner portions of the polygonal closed cross-section and flange portions extending in parallel to a flat face including a ridge line located at an innermost side of the curved form along the longitudinal direction in a radial direction of the component among the above ridge lines, a gutter-shaped pre-processed part with a curved form along its longitudinal direction is first press-formed from the metal sheet. The pre-processed part has plural ridge lines corresponding to the corner portions of the polygonal closed cross-section of the component in a cross-section form developed by cutting the component at a position corresponding to the ridge line located at the innermost side in the radial direction to provide a flange portion extending along the ridge line at the resulting respective ends wherein each of the ridge lines corresponding to the corner portions has a radius of curvature equal to or smaller than a radius of curvature of the corresponding ridge line of the component to have a length equal to or shorter than the length of the corresponding ridge line. Then, the pre-processed part is press-formed to deform inwardly in the cross-sectional direction at a position of one or more of the plural ridge lines to butt the ridge lines located at the innermost side and the flange portions to each other.

Therefore, the polygonal closed cross-section structural component with the curved form produced by the method to producing a polygonal closed cross-section structural component with a curved form can be shaped from a metal sheet by press forming so that the cost is low. Also, the flange portion exists only in the inside of the curved form of the component, which can contribute to reduce the weight of the component. Furthermore, when the component is press-formed from the pre-processed part, the difference of the length of the each ridge line is not produced between the component and the part or the length of the each ridge line is made longer in the form of the component so that the occurrence of wrinkles in the form of the component can be prevented.

DESCRIPTION OF REFERENCE SYMBOLS

1, 3, 6 component
1*a*, 1*b*, 1*c*, 1*d*, 3*a*, 3*b*, 3*c*, 3*d*, 6*a*, 6*b*, 6*c*, 6*d* ridge line
1*e*, 3*e*, 6*e* flange portion
2, 4, 7 pre-processed part
2*a*, 2*b*, 2*c*, 2*d*, 4*a*, 4*b*, 4*c*, 4*d*, 7*a*, 7*b*, 7*c*, 7*d* ridge line
2*e*, 4*e*, 7*e* flange portion
5 cam mold
5*a*, 5*b* shaping face
6*f* vertical wrinkles

DETAILED DESCRIPTION

Figure 1A:
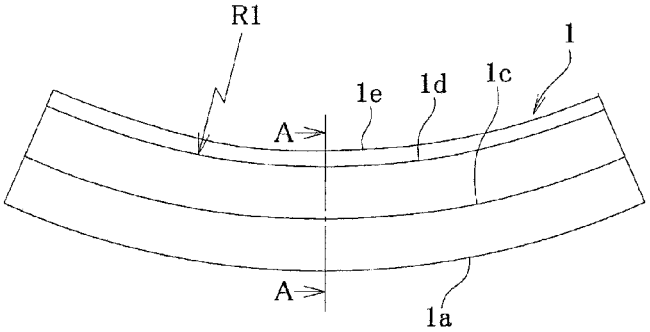
FIG. 1(A) is a side view of a closed cross-section structural component produced in an example of the method of producing a polygonal closed cross-section structural component with a curved form and FIG. 1(B) is a sectional view taken along a line A-A in the side view.
Figure 1B:
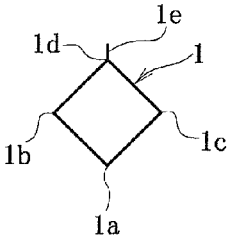

An example will be described in detail with reference to the drawings. FIG. 1(A) is a side view of a closed cross-section structural component produced in an example of the method of producing a polygonal closed cross-section structural component with a curved form, and FIG. 1(B) is a sectional view taken along a line A-A in the side view, and FIG. 2(A) is a side view of a pre-processed part produced in the example of the method of producing a polygonal closed cross-section structural component with a curved form, and FIG. 2(B) is a sectional view taken along a line B-B in the side view.

In this example, a cylindrical component 1 of a quadrangular closed cross-section structure as shown in FIGS. 1(A) and (B) is produced from a steel sheet. The component 1 has a curved form along a longitudinal direction of the component 1 and is provided with four ridge lines 1*a*, 1*b*, 1*c*, 1*d* extending along the longitudinal direction of the component 1 at positions corresponding to corner portions of the quadrangular closed cross-section and flange portions 1*e* extending on a flat face including the ridge line 1*d* (flat face parallel to a paper in FIG. 1(A)) along the ridge line 1*d* located at an innermost side in a radial direction of the curved from along the longitudinal direction of the component 1 (uppermost position in FIG. 1) among the ridge lines 1*a*-1*d* in the quadrangular closed cross-section of the component 1 and protruding inward in the radial direction. Also, the curved form of the component 1 has a radius of curvature R1, a center of which is located on a flat face including the ridge line 1*d* at the innermost side in the radial direction of the quadrangular closed cross-section or at the position of the ridge line 1*d*.

Figure 2A:
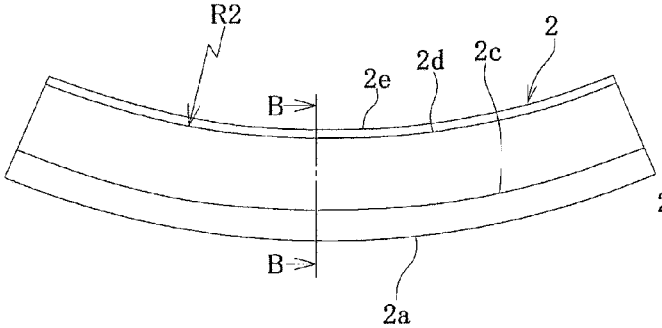
FIG. 2(A) is a side view of a pre-processed part produced in the example of the method of producing a polygonal closed cross-section structural component with a curved form and FIG. 2(B) is a sectional view taken along a line B-B in the side view.
Figure 2B:
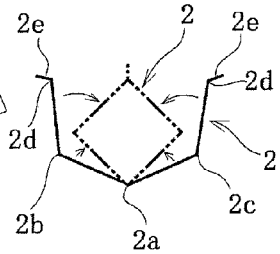

In this example of producing the component 1, a gutter-shaped pre-processed part 2 with a curved form along a longitudinal direction thereof as shown in FIGS. 2(A) and (B) is first press-formed from a steel sheet previously trimmed to a given contour shape, for example, with a bending and drawing mold. The pre-processed part 2 has an opened cross-section form developed by cutting the component 1 at a position of the ridge line 1*d* located at the innermost side to have a flange portion 1*e* extending along the ridge line 1*d* at the resulting respective ends as shown in FIG. 2(B), in which the part has four ridge lines corresponding to the corner portions of the polygonal closed cross-section of the component 1 and one ridge line increased by the above cutting or five ridge lines 2*a*-2*d* in total and two flange portions 2*e* extending along the two ridge lines 2*d* located at the innermost side in the radial direction (uppermost position in FIG. 2).

Figure 3:
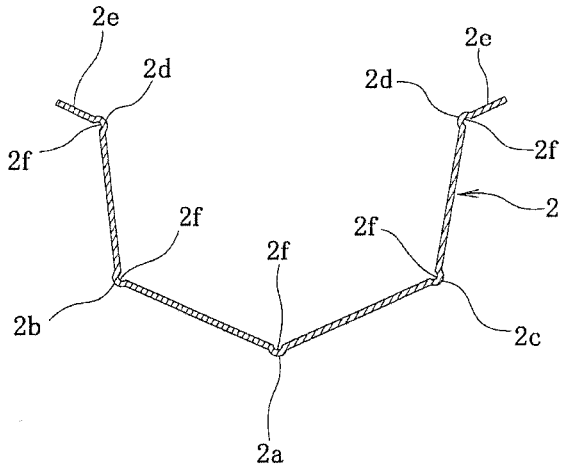
FIG. 3 is an enlarged sectional view showing the pre-processed part of FIG. 2.

Each of the ridge lines 2*a*-2*d* has a radius of curvature equal to or smaller than a radius of curvature of the corresponding ridge lines 1*a*-1*d* to have a length equal to or shorter than a length of the corresponding ridge lines 1*a*-1*d* in the component 1. For example, a radius of curvature R2 of the ridge line 2*d* located at the innermost side in the radial direction (uppermost position in FIG. 2) is made smaller than a radius of curvature R1 of the corresponding ridge line 1*d* in the component 1. Also, a polygonal line 2*f* of U-shaped groove type cross-section extending along each of the ridge lines 2*a*-2*d* is formed at an inner position sandwiched between both sides of each of the ridge lines 2*a*-2*d* in the pre-processed part 2 to easily deform the pre-processed part 2 at positions of such ridge lines in a cross-sectional direction at subsequent press-forming as enlarged and shown in FIG. 3.

The curved form of the each ridge line 2*a*-2*d* and flange portions 2*e* in the pre-processed part 2 extends on a flat face parallel to a paper face of FIG. 2(A) and along the flat face when the pre-processed part 2 is deformed so that the ridge lines other than the ridge line 2*a* are not parallel to the paper face and the each ridge line 2*b*-2*d* is moved to the same position of the corresponding ridge line 1*b*-1*d* of the component 1. The center of the radius of curvature R2 is located at a position separated vertically from the paper face (for example, on a flat face including the flange portion 2*e*) instead of the paper face of FIG. 2(A).

In the subsequent step, the pre-processed part 2 is press-formed into a closed cross-section form corresponding to the cross-section of the component 1 as shown by a phantom line in FIG. 2(B) by pushing the part with a usual cam mold (not shown) having a shaping form corresponding to the curved form of the component 1 to deform from the original cross-section form shown by a solid line in FIG. 2(B) in a horizontal direction in FIG. 2(B) inwardly in the cross-sectional direction to butt the ridge lines 2*d* located at the innermost side and the flange portions 2*e* extending along the ridge lines 2*d* to each other.

At this moment, the pre-processed part 2 is bent inwardly at the position of the each ridge line 2*a*-2*c* and outwardly at the position of the each ridge line 2*d*, wherein a length of a portion moving inward in the radial direction of the curved form of the component 1 is generally shortened by the bending along the curved form of these ridge lines. However, the pre-processed part 2 is deformed with the cam mold to make the radius of curvature in the each ridge line 2*a*-2*d* equal to that of the corresponding each ridge line 1*a*-1*d* in the component 1 while accepting the enlargement of the radius of curvature, whereby the length of the each ridge line 2*a*-2*d* is maintained or extended to match with a length of the each ridge line 1*a*-1*d* in the component 1, while the length of the flange portion 2*e* is extended to match with the length of the flange portion 1*e* in the component 1.

After the press forming, the butted flange portions 2*e* of the pre-processed part 2 are joined to each other, for example, by welding such as spot welding, laser welding or the like or with an adhesive or the like, whereby the component 1 of the closed cross-section structure can be produced.

According to the method of this example and a component 1 of a quadrangular closed cross-section structure with a curved form of this example produced by the method, therefore, the component 1 can be formed from the single metal sheet by press forming so that the cost is low, while the flange portion 1*e* is only an inner portion in the curved form of the component 1 and can contribute to reduce the weight of the component 1. Furthermore, when the component 1 is press-formed from the pre-processed part 2, the difference of length in the each ridge line is not caused or the length of the each ridge line is made longer in the component so that the occurrence of wrinkles can be prevented in the component 1.

According to the producing method of this example, the polygonal line 2*f* is formed at the each ridge line 2*a*-2*d* of the pre-processed part 2 by press forming so that the pre-processed part 2 is surely deformed inward at the position of the each ridge line 2*a*-2*d* at the subsequent step and hence the component 1 can be press-formed from the pre-processed part 2 in a high accuracy.

Figure 4A:
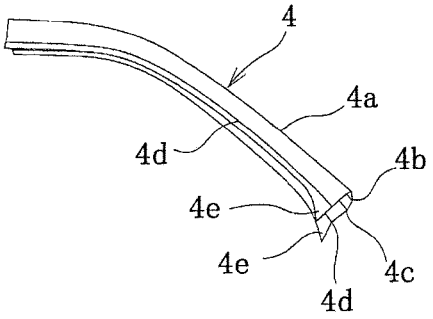
FIG. 4(A) is a perspective view of a pre-processed part produced in another example of the method of producing a polygonal closed cross-section structural component with a curved form and FIG. 4(B) is a perspective view of a closed cross-section structural component produced from the pre-processed part.
Figure 5A:
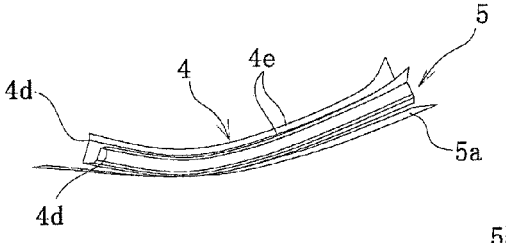
FIGS. 5(A) and (B) are perspective views of a pre-processed part produced in the example of the method of producing a polygonal closed cross-section structural component with a curved form and a press mold to produce a closed cross-section structural component form the pre-processed part.

FIGS. 4(A) and (B) are perspective views of a pre-processed part and a closed cross-section structural component produced from the pre-processed part in another example of the method of producing a polygonal closed cross-section structural component with a curved form, and FIGS. 5(A) and (B) are perspective views of a pre-processed part produced in the example of the method of producing a polygonal closed cross-section structural component with a curved form and a press mold to produce a closed cross-section structural component from the pre-processed part.

Figure 4B:
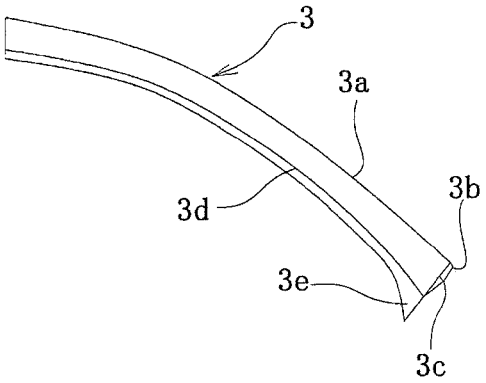

In the producing method of this example is produced a front pillar component 3 for a vehicle body as shown in FIG. 4(B). The front pillar component 3 has a global curved form having a relatively large radius of curvature and a middle curved form having a relatively small radius of curvature and also a closed cross-section structure near to a trapezoid having four ridge lines 3*a*-3*d* corresponding to corner portions as seen from an end face and further has a flange portion 3*e* located at an inside of the curved form.

When the front pillar component 3 is produced by press forming in the producing method of this example, a gutter-shaped pre-processed part 4 having a curved form along its longitudinal direction is first press-formed from a metal sheet previously trimmed to a given contour form with, for example, a bending and drawing mold as shown in FIG. 4(A). The pre-processed part 4 has an opened cross-section form developed by cutting the component 3 at a position of a ridge line 3*d* located at an innermost side in a radial direction of the curved form (lowermost position in FIG. 4) to have a flange portion 3*e* extending along the ridge line 3*d* at the resulting respective ends, in which the part has four ridge lines corresponding to the corner portions of the polygonal closed cross-section of the component 3 and one ridge line increased by the above cutting or five ridge lines 4*a*-4*d* in total and two flange portions 4*e* extending along the two ridge lines 4*d* located at the innermost side in the radial direction.

Each of the ridge lines 4*a*-4*d* has a radius of curvature equal to or smaller than a radius of curvature of the corresponding ridge lines 3*a*-3*d* to have a length equal to or shorter than a length of the corresponding ridge lines 3*a*-3*d* in the component 3. For example, a radius of curvature of the ridge line 4*d* located at the innermost side in the radial direction (lowermost position in FIG. 4) is made smaller than a radius of curvature of the corresponding ridge line 3*d* in the component 3.

Figure 5B:
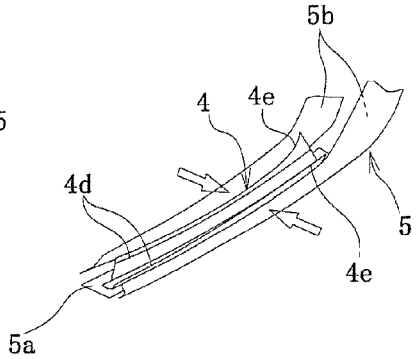

In the subsequent step, the pre-processed part 4 is press-formed into a closed cross-section form corresponding to the cross-section of the component 3 as shown in FIGS. 5(A) and (B) by pushing the pre-processed part 4 with a usual cam mold 5 having shaping faces 5*a*, 5*b* of a curved form corresponding to the curved form of the component 3 to deform from the horizontal direction inward in the cross-sectional direction as shown by an arrow in FIG. 5(B) to butt the ridge lines 4*d* located at the innermost side and the flange portions 4*e* extending along the ridge lines 4*d* to each other.

At this moment, the pre-processed part 4 is bent inwardly at the position of the each ridge line 4*a*-4*c* and outwardly at the position of the each ridge line 4*d*, wherein a length of a portion moving inwardly in the radial direction of the curved form of the component 3 is generally shortened by the bending along the curved form of these ridge lines. However, the pre-processed part 4 is deformed with the cam mold 5 to make the radius of curvature in the each ridge line 4*a*-4*d* equal to that of the corresponding each ridge line 3*a*-3*d* in the component 3 while accepting the enlargement of the radius of curvature, whereby the length of the each ridge line 4*a*-4*d* is maintained or extended to match with a length of the each ridge line 3*a*-3*d* in the component 3, while the length of the flange portion 4*e* is extended to match with the length of the flange portion 3*e* in the component 3.

After the press forming, the butted flange portions 4*e* of the pre-processed part 4 are joined to each other, for example, by welding such as spot welding, laser welding or the like or with an adhesive or the like, whereby the component 3 of the closed cross-section structure can be produced.

According to the method of this example and the component 3 of an approximately trapezoidal closed cross-section structure with a curved form of the example produced by the method, therefore, the component 3 can be formed from the single metal sheet by press forming like in the previous example of the method so that the cost is low, while the flange portion 3*e* is only an inner portion in the curved form of the component 3 and can contribute to reduce the weight of the component 3. Furthermore, when the component 3 is press-formed from the pre-processed part 4, the difference of length in the each ridge line is not caused or the length of the each ridge line is made longer in the component so that the occurrence of wrinkles can be prevented in the component 3.

Figure 6A:
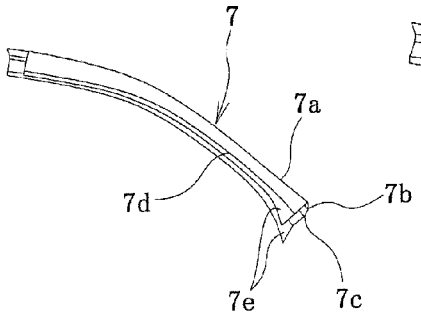
FIGS. 6(A) and (B) are perspective views of a pre-processed part produced by a method of producing a polygonal closed cross-section structural component with a curved form as a comparative example and a closed cross-section structural component produced from the pre-processed part, respectively.
Figure 6B:
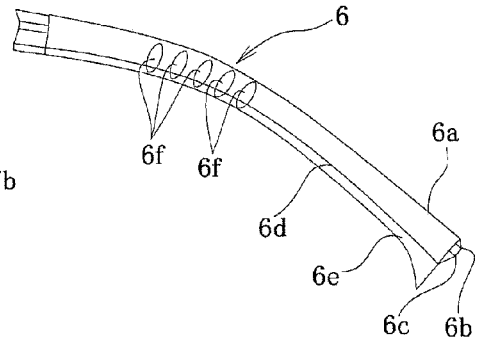

FIGS. 6(A) and (B) are perspective views of a pre-processed part and a closed cross-section structural component produced from the pre-processed part in a comparative example of the method of producing a polygonal closed cross-section structural component with a curved form. In the producing method of this comparative example is produced a front pillar component 6 for a vehicle body as shown in FIG. 6(B). The front pillar component 6 has a global curved form having a relatively large radius of curvature and a middle curved form having a relatively small radius of curvature and also a closed cross-section structure near to a trapezoid having four ridge lines 6*a*-6*d* corresponding to corner portions as seen from an end face and further has flange portions 6*e* located at an inside of the curved form like the front pillar component 3 produced in the previous example.

When the front pillar component 6 is produced by press forming in the producing method of the comparative example, a gutter-shaped pre-processed part 7 having a curved form along its longitudinal direction is first press-formed from a metal sheet previously trimmed to a given contour form with, for example, a bending and drawing mold as shown in FIG. 6(A). The pre-processed part 7 has an opened cross-section form developed by cutting the component 6 at a position of a ridge line 6*d* located at an innermost side in a radial direction of the curved form (lowermost position in FIG. 6) to have a flange portion 6*e* extending along the ridge line 6*d* at the resulting respective ends, in which the part has four ridge lines corresponding to the corner portions of the polygonal closed cross-section of the component 6 and one ridge line increased by the above cutting or five ridge lines 7*a*-7*d* in total and two flange portions 7*e* extending along the two ridge lines 7*d* located at the innermost side in the radial direction. The each ridge line 7*a*-7*d* has the same radius of curvature as that of the corresponding ridge line 6*a*-6*d* to have the same length as that of the ridge line 6*a*-6*d* of the component 6.

In the subsequent step, the pre-processed part 7 is press-formed into a closed cross-section form corresponding to the cross-section of the component 6 by pushing with a usual cam mold (not shown) having shaping faces of a curved form corresponding to the curved form of the component 6 to deform from the horizontal direction of the pre-processed part 6 inward in the cross-sectional direction to butt the ridge lines 6*d* located at the innermost side and the flange portions 6*e* extending along the ridge lines 6*d* to each other.

At this moment, the pre-processed part 7 is bent inward at the position of the each ridge line 7*a*-7*c* and outward at the position of the each ridge line 7*d*, wherein a length of a portion moving inwardly in the radial direction of the curved form of the component 6 is shortened by the bending along the curved form of these ridge lines to cause a surplus of a sheet in the longitudinal direction of the component 6. According to the producing method of the comparative example, therefore, vertical wrinkles 6*f* are caused at a side face of the curved form in the component 6 as shown in FIG. 6(B) different from the producing method of the aforementioned examples.

Although the illustrated examples are explained, our methods are not limited to the above examples and may be properly modified within the scope described in the appended claims. For example, the number of ridge lines in the component may be other than four, and the polygonal line may be formed in a V-shaped cross-section or may not be produce a protrusion at its opposite side.

INDUSTRIAL APPLICABILITY

According to the method of producing a polygonal closed cross-section structural component with a curved form, polygonal closed cross-section structural components with a curved form can be produced from a metal sheet through press forming by this method so that the cost is low, while the flange portion is only an inner portion in the curved form of the component and can contribute to reduce the weight of the component. Furthermore, when the component is press-formed from the pre-processed part, the difference of length in the each ridge line is not caused or the length of the each ridge line is made longer in the component so that the occurrence of wrinkles can be prevented in the component.

The invention claimed is:

1. A method of producing a polygonal closed cross-section structural component with a curved form along its longitudinal direction having plural ridge lines corresponding to corner portions of the polygonal closed cross-section and two flange portions extending in parallel to a flat face including a ridge line located at an innermost side in a radial direction of the curved form of the component along the longitudinal direction among the ridge lines from a metal sheet, comprising:

a step of press-forming the metal sheet into a gutter-shaped pre-processed part with a curved form along its longitudinal direction, the pre-processed part having plural ridge lines corresponding to the corner portions of the polygonal closed cross-section of the component in a cross-sectional form, two flange portions respectively extending along two of the plural ridge lines of the pre-processed part, the two ridge lines corresponding to the ridge line that will be located at an innermost side of the component in a radial direction, and an opening between the two ridge lines, wherein each of the plural ridge lines of the gutter-shaped pre-processed part corresponding to the corner portions of the component has a radius of curvature equal to or smaller than a radius of curvature of the corresponding ridge line of the component so that the ridge lines of the gutter-shaped pre-processed part have a length equal to or shorter than the length of the corresponding ridge line of the component; and a step of press-forming the pre-processed part to deform inwardly in the cross-sectional direction at a position of one or more of the plural ridge lines to butt the two ridge lines corresponding to the ridge line located at the innermost side of the component and the flange portions to each other.

2. The method according to claim 1, further comprising press-forming a polygonal line of a groove-shaped cross-section along one or more of the plural ridge lines of the pre-processed part and deforming the pre-processed part inwardly in the cross-sectional direction at a position of the ridge line(s) that was press-formed.

* * * * *